US005311676A

United States Patent [19]

Hughes et al.

[11] Patent Number: 5,311,676

[45] Date of Patent: May 17, 1994

[54] CHANGEABLE SHOE COVERING

[76] Inventors: Thomas S. Hughes; Marielena Brown, both of 31310 Eagle Haven Cir., Ste. 100, Rancho Palos Verdes, Calif. 90274

[21] Appl. No.: 73,231

[22] Filed: Jun. 2, 1993

Related U.S. Application Data

[63] Continuation-in-part of Ser. No. 982,800, Nov. 30, 1992, abandoned.

[51] Int. Cl.[5] ..... A43B 3/24

[52] U.S. Cl. ..... 36/100; 36/7.1 R; 36/72 R

[58] Field of Search ..... 36/1.5, 100, 101, 7.1 R, 36/72 R, 10, 97

[56] References Cited

U.S. PATENT DOCUMENTS

| | | | |
|---|---|---|---|
| 1,382,748 | 6/1921 | Slasor | 36/72 R |
| 2,171,654 | 9/1939 | Hinchliff et al. | 36/72 R |
| 2,434,331 | 1/1948 | Miller et al. | 36/72 R |
| 2,986,823 | 6/1961 | Kos | 36/7.1 R |
| 3,141,247 | 7/1964 | Mackay | 36/7.1 R |
| 3,221,421 | 12/1965 | Liebmann et al. | 36/100 |
| 3,270,442 | 9/1966 | Liebmann et al. | 36/100 |
| 3,289,329 | 12/1966 | Weiss | 36/10 |
| 3,373,510 | 3/1968 | Memole et al. | 36/100 |
| 4,850,122 | 7/1989 | Schwab, Jr. | 36/72 R |

*Primary Examiner*—Paul T. Sewell
*Assistant Examiner*—Ted Kavanaugh
*Attorney, Agent, or Firm*—Lee W. Tower

[57] ABSTRACT

A cover for a woman's shoe of a type having a projecting heel, a shoe front sole, and an upper defining a foot opening and including a shoe toe area, a shoe upper heel area, and a shoe upper instep area, the combination including: a stretch cover for covering a surface of a woman's shoe having a D shaped opening in the stretch cover for receiving the shoe into the stretch cover; an elastic band for retaining the stretch cover on the shoe upper heel area attached to the opening in the stretch cover; and a overlap cover, integral to the stretch cover and forming a straight side of the D shaped opening in the stretch cover, for stretching the stretch cover over the shoe toe area and the shoe upper instep area adapted to stretch across the foot opening in the shoe from the shoe toe area to over the shoe upper instep area when the shoe is inserted into the stretch cover and before a foot is inserted into the shoe, and adapted to stretch down and inside the shoe toe area thereby stretching the stretch cover over the shoe toe area and over the shoe upper instep area when a foot is inserted into the foot opening.

5 Claims, 7 Drawing Sheets

FIG. 1
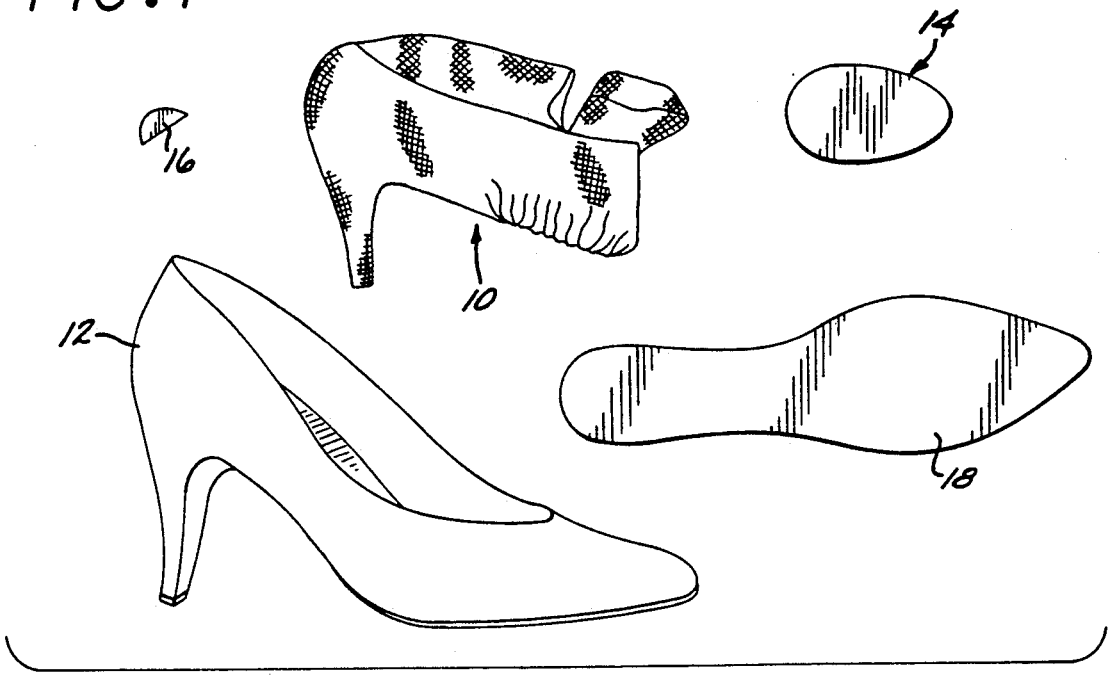
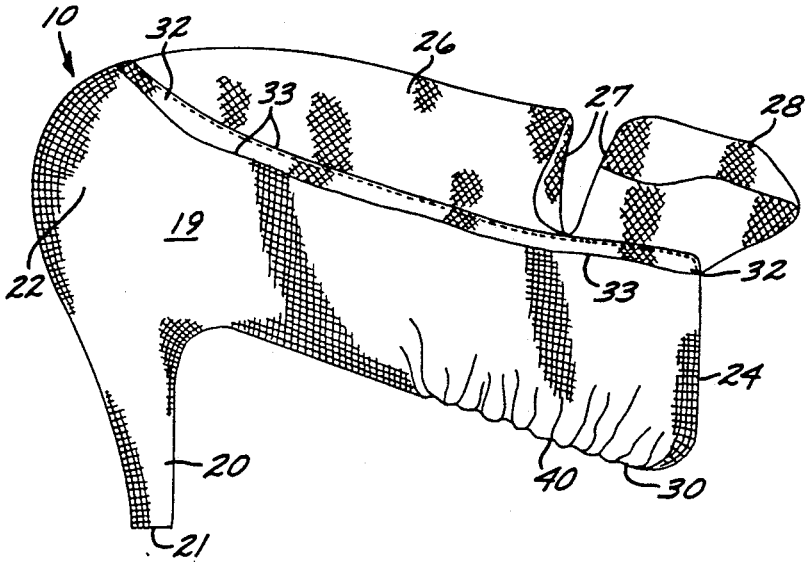
FIG. 2
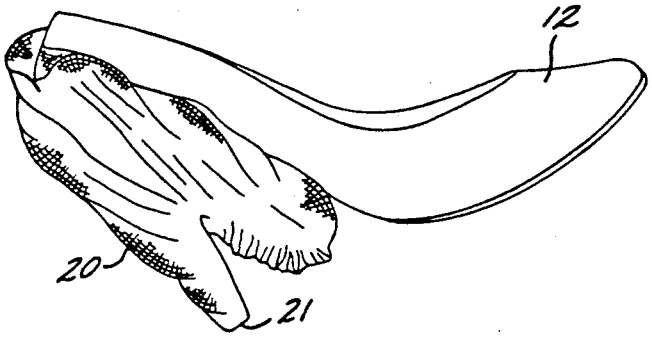
FIG. 3

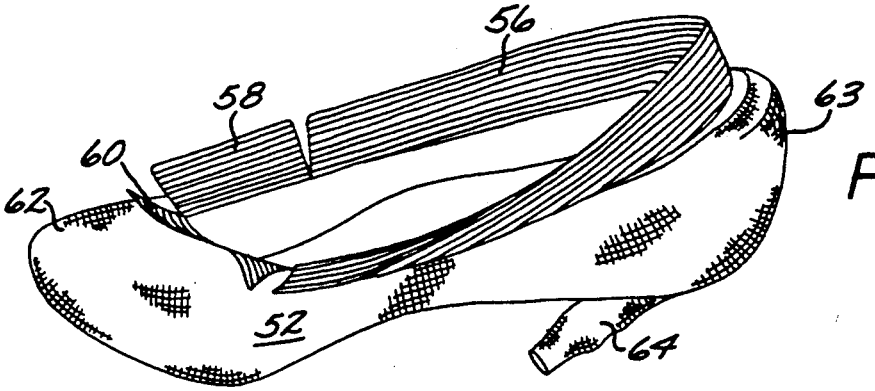
FIG. 19
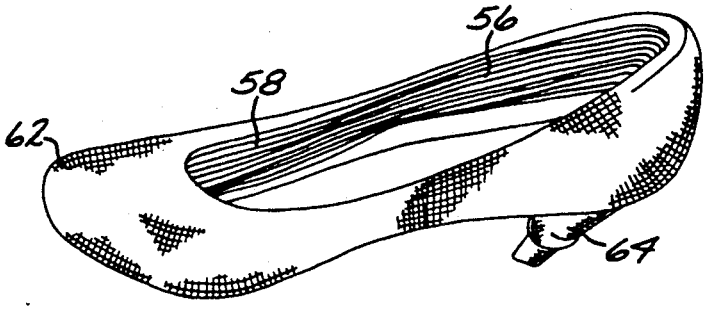
FIG. 20
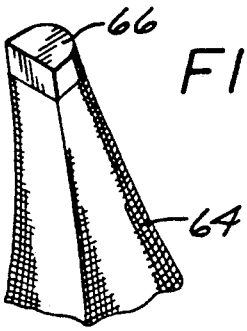
FIG. 21
FIG. 22
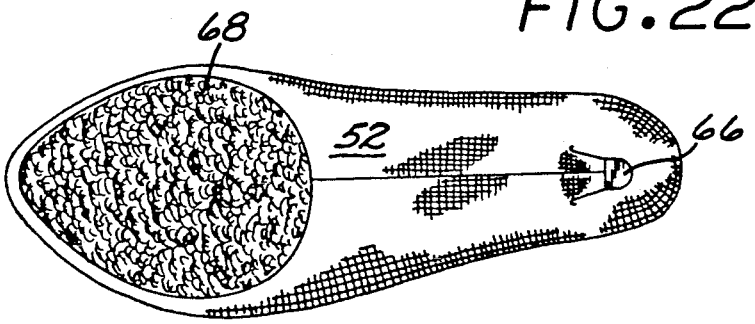

CHANGEABLE SHOE COVERING

This is a continuation in part of patent application Ser. No. 07/982,800 that was filed on Nov. 30, 1992 now abandoned.

BACKGROUND OF THE INVENTION

1. Field of the Invention

This invention relates to shoes and a changeable covering that covers the shoe in an fashionable manner. The invention is especially applicable to women's shoes.

2. Prior Art

Often it is desirable to change the appearance of a shoe. This is particularly true in the case of women's shoes, because it may be desirable to match the shoe color or pattern to match a dress for a special function such as a wedding. In the prior art there are techniques to change a shoe's color. One way is to dye the shoe a particular color. This is rather straight forward to do, but once the shoe is dyed it may not be possible to change the color back to the prior color. In general it is easier to dye a shoe a darker color, but more difficult to dye a shoe a lighter color.

Another way to change the shoe color or pattern is to take the shoes to a shoe repair shop that can sew a new covering onto the shoe. This is the method currently used to pattern match a shoes to the color of a dress. For example, for a wedding, the bridesmaids may have their high heel pumps covered with the same material as in their dresses. This cloth, which can have any pattern, would be sewn onto the shoes by the shoe repair shop. The result is a fashionable look; however, the cost of covering a shoe in this manner is quite high. Also once the event, such as the wedding is over, the covered shoes may not be very useful for everyday wear, because, for example, if the shoes are covered to match a particular dress, they will probably not match any other attire in the person's wardrobe.

What is needed is a way to cover a shoe to match a particular dress or attire without permanently changing the shoe. What would be desirable is a changeable shoe covering that could be used for a special occasions and then removed to restore the shoe to its original appearance and then the shoe could be covered again with a different changeable cover, if desired. It should also be possible to wash the changeable cover whenever it became soiled through normal use. Another use of a changeable shoe cover would be to cover a comfortable but badly scuffed shoe to give it a new attractive appearance.

SUMMARY OF THE INVENTION

The invention is a changeable shoe cover that is custom tailored to fit over a shoe and in particular to fit over a woman's high heel pump. The changeable shoe cover is made of stretch material and has an openings for the heel of the shoe and the sole of the shoe. There is elastic at the changeable shoe cover opening for the sole of the shoe. The changeable shoe cover also has a front interior liner and a rear interior liner. There is an opening between the front interior liner and the rear interior liner. The changeable shoe covering is first placed on the heel of the shoe and the rear interior liner is placed over the rear of the shoe. Then the changeable shoe covering is stretched over the front of the shoe and the rear and front interior liners tucked into the shoe and the liners are held inside the shoe with a cover retainer insert that goes inside the shoe. The sole of the shoe that is not covered at the opening on the changeable shoe cover at the sole is then covered with a nonslip pad that has adhesive on one side and a nonslip surface on the other side. The opening in the changeable shoe cover is then sewn at the heel and a heel pad glued onto the heel. The result is a shoe covered with stretch material that is quite attractive. The changeable cover can be removed by removing the nonslip pad, the heel pad and the cover retainer insert and then just taking the cover off the shoe in the reverse that it was put onto the shoe.

Another embodiment of the invention is a changeable shoe cover made of stretch material that has openings for the heel of the shoe and the sole of the shoe. There is elastic at the changeable shoe cover opening for the sole of the shoe. There is also an opening in the changeable shoe cover that is the shape of the opening to the shoe interior. The opening in the changeable shoe cover that is the shape of the opening to the shoe interior has a plurality of attached elastic bands. The changeable shoe cover is first put over the toe of the shoe and then the changeable shoe cover is stretched over the heel of the shoe. Then the plurality of elastic bands are tucked into the interior of the shoe. The sole of the shoe that is not covered at the opening on the changeable shoe cover at the sole is then covered with a nonslip pad that has adhesive on one side and a nonslip surface on the other side. The opening in the changeable shoe cover can then sewn at the heel and a heel cap glued onto the heel. The result is a shoe covered with stretch material that is quite attractive. The changeable cover can be removed by removing the nonslip pad, the heel cap and then just taking the cover off the shoe in the reverse that it was put onto the shoe.

Another alternate embodiment of the invention is a cover for a woman's shoe of a type having a projecting heel, a shoe front sole, and an upper defining a foot opening and including a shoe toe area, a shoe upper heel area, and a shoe upper instep area. The inventive combination includes a stretch cover for covering a surface of a woman's shoe having a D shaped opening in the stretch cover for receiving the shoe into the stretch cover and an elastic band for retaining the stretch cover on the shoe upper heel area attached to the opening in the stretch cover. An overlap cover, integral to the stretch cover and forming a straight side of the D shaped opening in the stretch cover, stretches the stretch cover over the shoe toe area and the shoe upper instep area. The overlap cover is adapted to stretch across the foot opening in the shoe from the shoe toe area to over the shoe upper instep area when the shoe is inserted into the stretch cover and before a foot is inserted into the shoe, and adapted to stretch down and inside the shoe toe area thereby stretching the stretch cover over the shoe toe area and over the shoe upper instep area when a foot is inserted into the foot opening.

In a specific embodiment, the elastic band includes a strip of elastic band having a length, a first end and a second end, attached along the length to a curved portion of the D shaped opening in the stretch cover. The elastic band is attached at the first end of the elastic band to a first end of the straight side of the D shaped opening in the stretch cover, and attached at the second end of the elastic band to a second end of the straight side of the D shaped opening in the stretch cover.

BRIEF DESCRIPTION OF THE DRAWINGS

A better understanding of the invention and its advantages will be apparent from the detailed description taken in conjunction with the accompanying drawings in which:

FIG. 1 shows an ensemble of the elements for a changeable shoe cover, including changeable shoe covering, nonslip pad, heel material and cover retainer insert and an uncovered shoe.

FIG. 2 shows a changeable shoe covering.

FIG. 3 shows the changeable shoe covering being placed over the shoe heel.

FIG. 19 shows an alternate changeable shoe cover on the shoe with the elastic bands protruding.

FIG. 20 shows an alternate changeable shoe cover on the shoe with the elastic bands tucked inside the shoe.

FIG. 21 shows the heel cap placed over an alternate changeable shoe cover on the heel of the shoe.

FIG. 22 shows the shoe bottom with an alternate changeable cover and the nonslip pad and heel cap installed.

DESCRIPTION OF THE PREFERRED EMBODIMENTS

Figure 4:
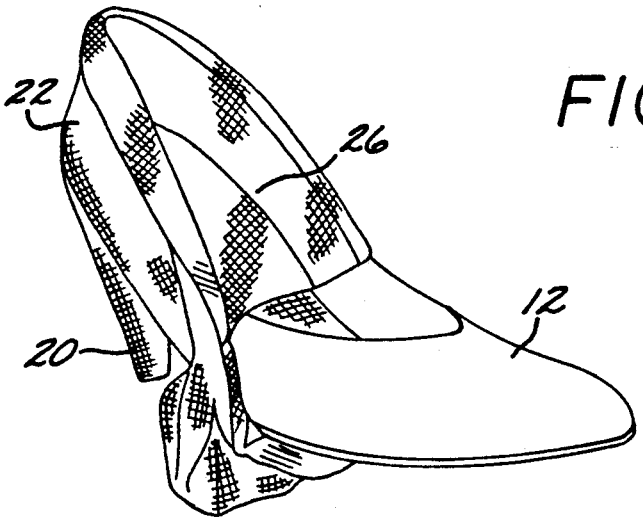
FIG. 4 shows the changeable shoe covering being placed over the back of the shoe and the rear interior liner over the shoe top.

Referring now to the drawings, and more particularly, to FIG. 1, there is shown a changeable shoe covering 10 of the present invention. This changeable shoe covering 10 is designed to be placed over a high heel pump 12 to cover it in an attractive manner. The changeable shoe covering 10 is used together with nonslip pad 14, heel material 16 and cover retainer insert 18. FIG. 2 is a detail of the changeable shoe covering 10, which is made of stretch material 19. The stretch material 19 is sewn together to make a cover that has a cover heel opening 21, a cover sole opening 40, and an edge in shape of shoe interior opening 33. There is elastic 30 around cover sole opening 40 and elastic 32 around edge in shape of shoe interior opening 33. The stretch material 19 has a stretch shoe back cover 22, a stretch shoe toe cover 24 and a stretch heel cover 20. The rear interior liner 26 is designed to fit into the heel of a shoe and the front interior liner 28 is designed to fit into the toe of a shoe.

Figure 5:
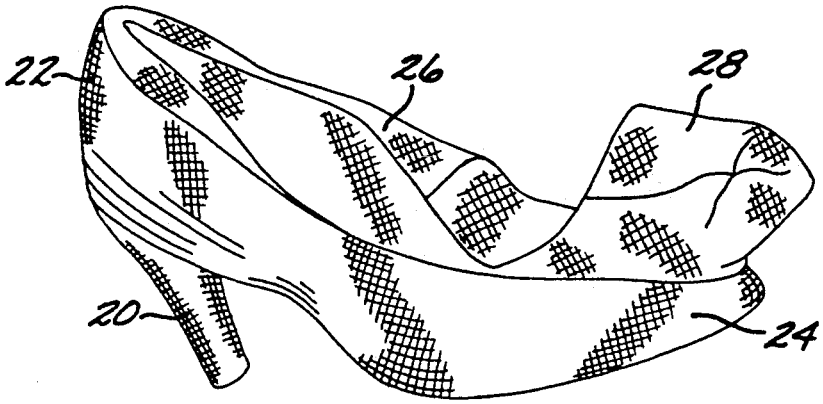
FIG. 5 shows the changeable shoe covering placed over the front of the shoe with the front and rear liners protruding.
Figure 6:
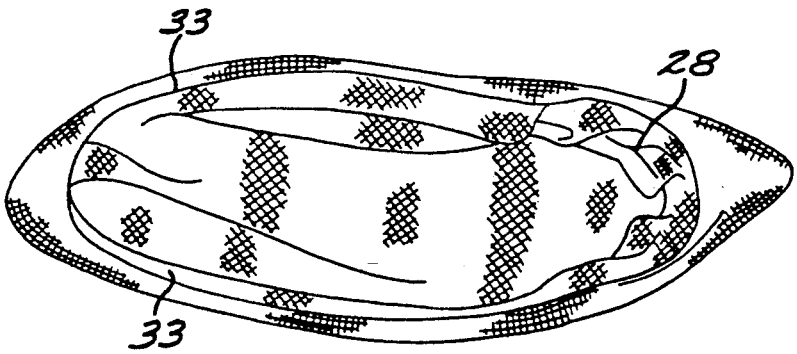
FIG. 6 shows the changeable shoe covering with the front and rear liners tucked into the shoe.
Figure 7:
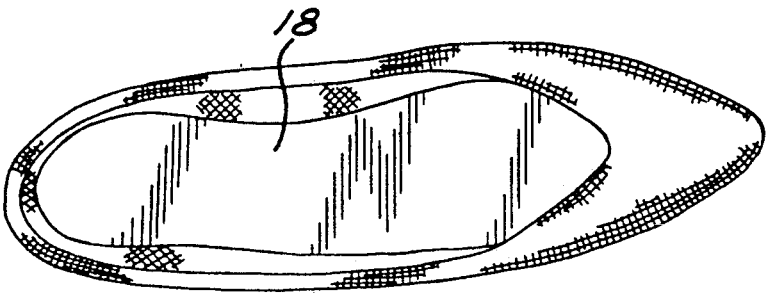
FIG. 7 shows the changeable shoe covering fully on the shoe with a cover retainer insert inside the shoe.

FIG. 3 shows the first step is putting changeable shoe covering 10 onto high heel pump 12. First the heel on the shoe is placed through cover opening between front and rear liner 27 and into stretch heel cover 20. FIG. 4 shows the stretch heel cover 20 and stretch shoe back cover 22 covering the shoe and rear interior liner 26 over the rear of the shoe. FIG. 5 shows the next step of stretching changeable shoe covering 10 and stretch shoe toe cover 24 over the toe of the shoe with the front interior liner 28 protruding over the shoe. Then FIG. 6 shows the rear interior liner 26 and the front interior liner 28 tucked into the shoe. Next FIG. 7 shows cover retainer insert 18 placed inside the shoe for retaining rear interior liner 26 and front interior liner 28 inside the shoe and stretching the stretch material 19 of the changeable shoe covering 10 over the shoe.

Figure 8:
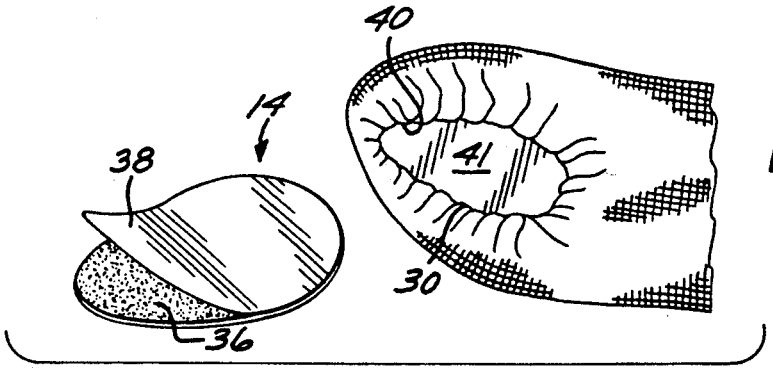
FIG. 8 shows the part of the sole of the shoe not covered by the changeable covering and a nonslip pad.
Figure 9:
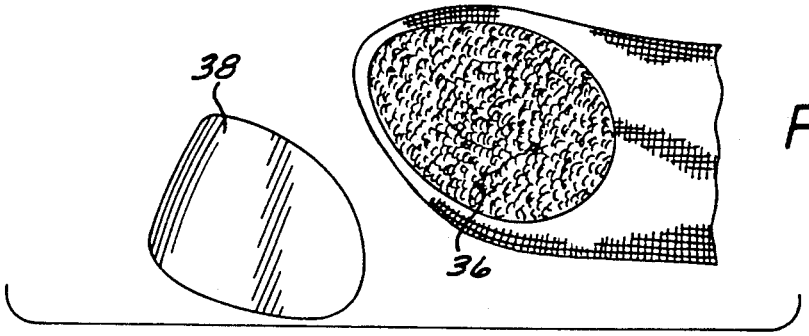
FIG. 9 shows the nonslip pad attached to the sole of the shoe with adhesive.
Figure 10:
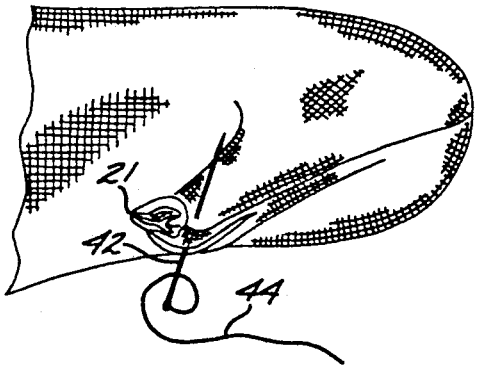
FIG. 10 shows a needle and thread being used to stitch the changeable shoe covering at the end of the heel.
Figure 11:
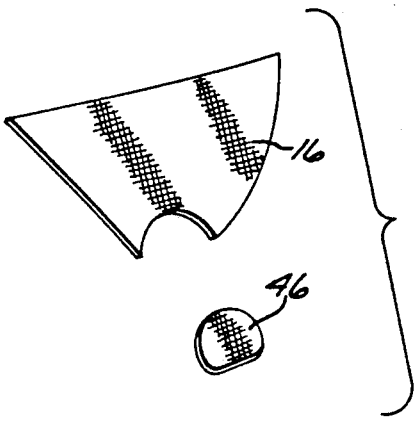
FIG. 11 shows the heel pad cut from the heel material.
Figure 12:
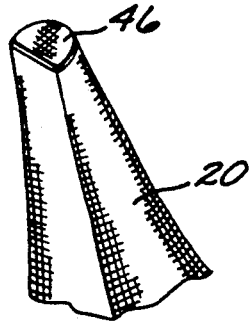
FIG. 12 shows the heel with the heel pad glued onto the heel.
Figure 13:
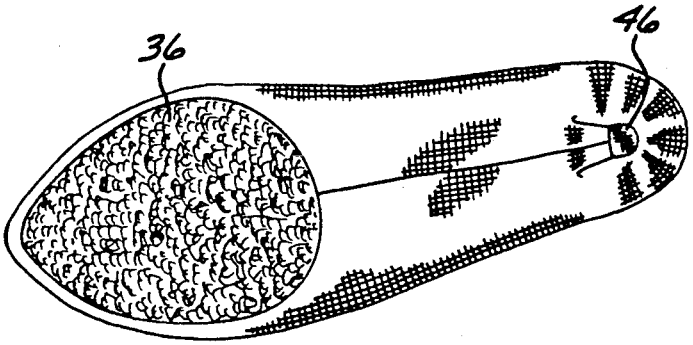
FIG. 13 shows the bottom of the covered shoe with both the nonslip pad and the heel pad installed.
Figure 14:
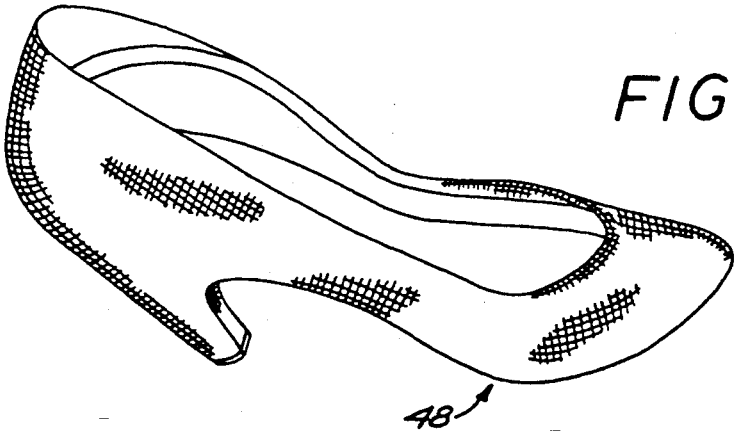
FIG. 14 shows a side view of the covered shoe.
Figure 15:
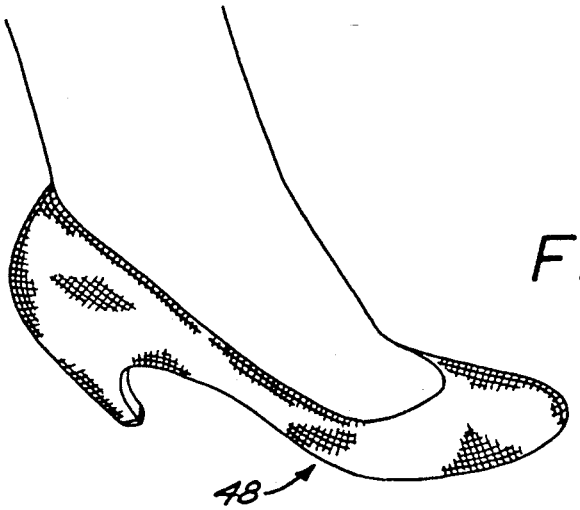
FIG. 15 shows the covered shoe being worn.

Once the cover is installed, the cover sole opening 40 surrounded by elastic 30 leaves a portion of the shoe sole 41 shoe exposed, as shown in FIG. 8. The nonslip pad 14 has a nonslip adhesive pad 36 that has the adhesive surface covered by a peel off cover 38. The nonslip adhesive pad 36 is put over the shoe sole 41 providing a walking surface, as shown in FIG. 9. Then the cover heel opening 21 is stitched with a needle 42 and thread 44 and finally a heel pad 46 is cut from heel material 16 and glued onto the covered shoe heel, as shown in FIGS. 10, 11 and 12. FIGS. 13, 14 and 15 show bottom, side and worn illustrations of a changeable shoe covering 10 fully installed over a shoe. Removing the shoe cover is just a matter of reversing the steps of putting on the cover.

Figure 16:
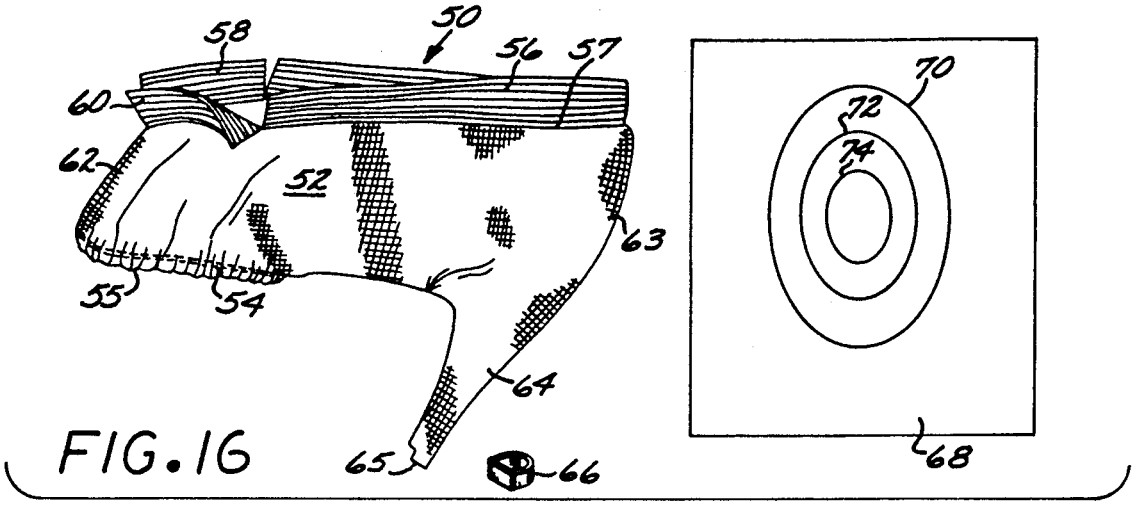
FIG. 16 shows an ensemble of the elements for an alternate embodiment of a changeable shoe cover, including changeable shoe covering, nonslip pad, and heel cap.

Another preferred embodiment of the invention is shown in FIG. 16, including changeable shoe covering 50, heel cap 66 and nonslip pad 68. The changeable shoe covering 50 is made of stretch material 52, which has stretch shoe toe cover 62, cover sole opening 55, stretch shoe back cover 63, stretch heel cover 64, cover heel opening 65 and edge in shape of shoe interior opening 57. There is elastic 54 around cover sole opening 55. Along the edge in shape of shoe interior opening 57 there are a series of elastic bands: elastic band 56, elastic band 58 and elastic band 60. The nonslip pad 68 can be made of the same material as nonslip pad 14; however, one rectangular piece of material is provided with large shoe trim line 70, medium shoe trim line 72 and small shoe trim line 74.

Figure 17:
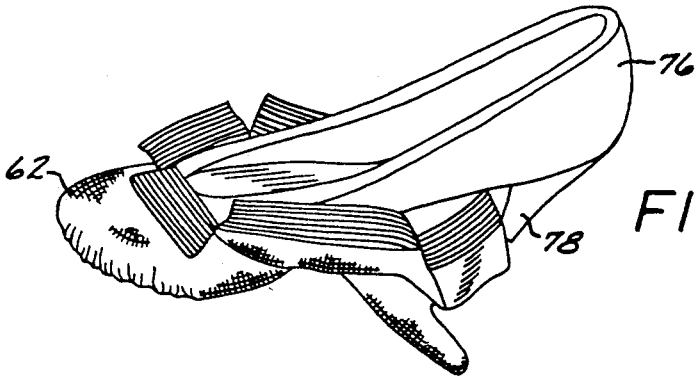
FIG. 17 shows an alternate changeable shoe cover being placed over the front of the shoe.
Figure 18:
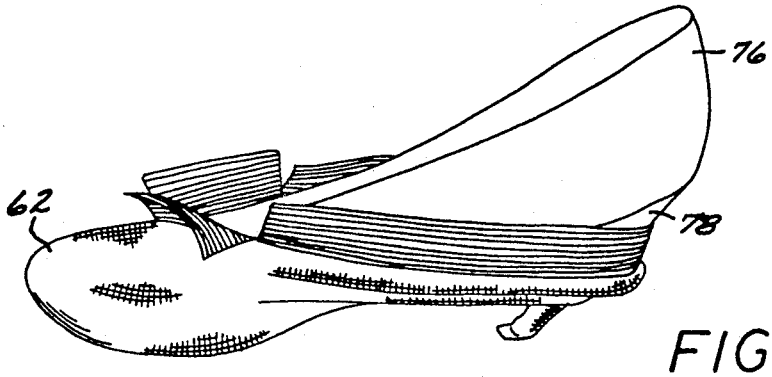
FIG. 18 shows an alternate changeable shoe cover being placed over the heel of the shoe.

The first step in putting on the cover is to place stretch shoe toe cover 62 over the toe of the shoe, as shown for high heel pump 76, in FIG. 17. At this point, heel 78 is not covered. Then, as shown in FIG. 18, the changeable shoe covering 50 is stretched over heel 78, which is inserted into stretch heel cover 64, and then the changeable shoe covering 50 is stretched over the back of the shoe, as shown in FIG. 19, which also shows the elastic bands 56, 58, and 60 extending upward from the changeable shoe covering 10 and out of the shoe. The next step in installing the changeable shoe covering 10 is to tuck the elastic bands 56, 58, and 60 into the shoe. The elastic bands stretch the stretch material 52 firmly over the shoe.

The cover heel opening 65 is stitched in the same manner as shown in FIG. 10 and then heel cap 66 is glued onto the heel. To cover the exposed part of the sole, the user trims nonslip pad 68 along the appropriate trim line, depending on the shoe size, and then installs the nonslip pad 68 on the bottom of the shoe in the manner shown in FIGS. 8 and 9, over the shoe sole 41 that in the case of changeable shoe covering 50 would be exposed through the cover sole opening 55. The bottom of the shoe covered with the changeable shoe covering 50 with the nonslip pad 68 and heel cap 66 installed is shown in FIG. 22.

The changeable shoe covering 10 and changeable shoe covering 50 provide a way to cover a shoe to match a particular dress or attire without permanently changing the shoe and can be used for special occasions and then removed to restore the shoe to its original appearance. The changeable cover can be washed whenever it becomes soiled through normal use. The changeable shoe cover can also be used permanently to cover a comfortable but badly scuffed shoe to give it a new attractive appearance.

Figure 23:
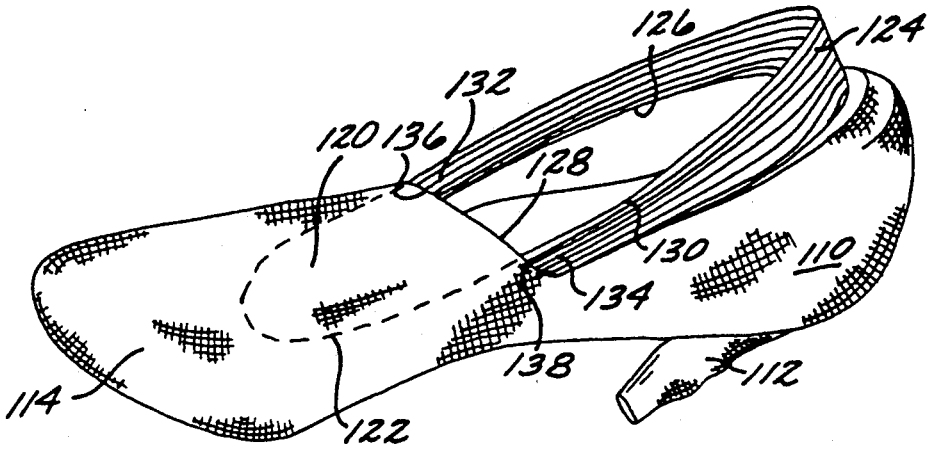
FIG. 23 shows another alternate changeable shoe cover placed onto a shoe, according to the present invention.
Figure 24:
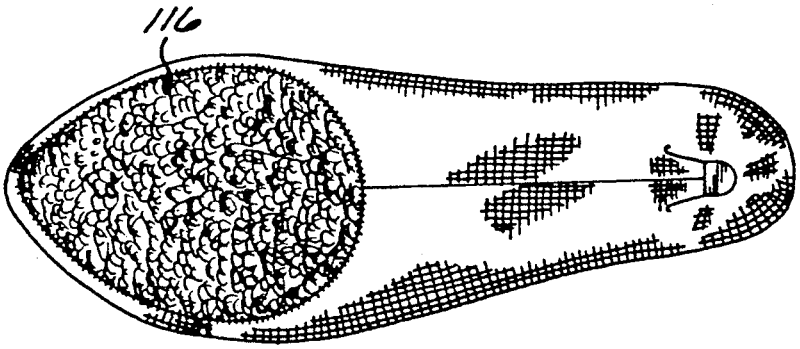
FIG. 24 shows the alternate changeable shoe cover with a pad sewn on and a heel cap installed, according to the present invention.

Another preferred embodiment of the invention is shown in FIG. 23. The invention is a cover for a woman's shoe of a type having a sole, a projecting heel 101, and an upper defining a foot opening 122, which in general defines a high heel pump 12, as shown in FIG. 1. The shoe itself has shoe toe area 102., a shoe front sole 104, a shoe upper instep area 106, and a shoe upper heel area 108, as shown in FIG. 1. As shown in FIG. 23, a stretch cover 110 includes a projecting heel covering 112 for covering the projecting heel 101 and a shoe toe covering 114 for covering the shoe toe area 102, which are both integral to the stretch cover. As shown in FIG. 24, a pad 116 is sewn to the shoe toe covering where the stretch cover covers the shoe front sole 104 when the stretch cover is fitted onto the shoe.

The stretch cover 110 has a D shaped opening in the stretch cover for receiving the shoe into the stretch cover. In FIG. 23 the D shaped opening is defined by a straight side 128 and by a curved portion 130. An elastic band 124 retains the stretch cover on the shoe upper heel area and is attached to the stretch cover 110 along edge 126.

An overlap cover 120 is integral to the stretch cover and forms the straight side 128 of the D shaped opening in the stretch cover 110. The overlap cover 120 is adapted to stretch across the foot opening in the shoe from the shoe toe area 102 to over the shoe upper instep area 106 when the shoe is inserted into the stretch cover and before a foot is inserted into the shoe, as shown in FIG. 23. The overlap cover 120 is also, adapted to stretch down and inside the shoe toe area 102 thereby stretching the stretch cover over the shoe toe area and over the shoe upper instep area when a foot is inserted into the foot opening.

The elastic band 124 has a length, a first end 132 and a second end 134. The elastic band 124 is attached along its length to the curved portion 130 of the D shaped opening in the stretch cover. The elastic band is attached at the first end 132 of the elastic band 124 to a first end 136 of the straight side of the D shaped opening in the stretch cover, and attached at the second end 134 of the elastic band 124 to a second end 138 of the straight side of the D shaped opening in the stretch cover.

The inclusion of overlap cover 120 makes the shoe cover very comfortable to wear and solves the problem of making a shoe cover that can fit many different high heels, because the stretch material easily expands or contracts to fit shoes with different openings for the shoe toe area.

After the stretch cover is on the shoe in a configuration as shown in FIG. 23, to wear the shoe, a woman's toes are put on top of the overlap cover 120 stretching across the foot opening 122 and then the woman's toes push the stretch material down and inside the shoe toe area thereby stretching the stretch cover 110 over the shoe toe area and over the shoe upper instep area. Then the elastic band is inserted into foot opening 122 in the shoe and the woman's heel is put into the shoe upper heel area 108.

It is thought that the present invention and many of its attendant advantages will be understood from the foregoing description and it will be apparent that various changes may be made in the form, construction and arrangement of the parts thereof and in the methods used without departing from the spirit and scope of the invention or sacrificing all of its material advantages, the forms hereinbefore described being merely a preferred or exemplary embodiments thereof. Accordingly,

What is claimed is:

1. A cover for a woman's shoe of a type having a projecting heel, a shoe front sole, and a upper defining a foot opening and including a shoe toe area, a shoe upper heel area, and a shoe upper instep area, the cover comprising:

stretch cover means for covering a surface of a woman's shoe having a D shaped opening in said stretch cover means for receiving said shoe into said stretch cover means;

noncontinuous elastic strip means having a first end and a second end wherein said first end is not joined to said second end for retaining said stretch cover means on said shoe upper heel area attached to said D shaped opening in said stretch cover means; and overlap means, integral to said stretch cover means and forming a straight side of said D shaped opening in said stretch cover means, for stretching said stretch cover means across said foot opening in said shoe;

wherein said overlap means stretches across said foot opening in said shoe from said shoe toe area to cover said shoe upper instep area when said shoe is inserted into said stretch cover means and before a foot is inserted into said shoe; and wherein said overlap means stretches down and inside said shoe toe area thereby stretching said stretch cover means over said shoe toe area when a foot is inserted into said foot opening.

2. The cover of claim 1 wherein said noncontinuous elastic strip means further comprises:

an elastic strip having a length, a first end on said elastic strip and a second end on an end of said elastic strip opposite to said first end of said elastic strip and not joined to said first end attached along said length to a curved portion of said D shaped opening in said stretch cover means, and attached at said first end of said elastic strip to a first end of said straight end of said elastic strip to a first end of said straight side of said D shaped opening in said stretch cover means, and attached at said shaped end of said elastic strip to a second end of said straight side of said D shaped opening in said stretch cover means.

3. The cover of claim 2 wherein said stretch cover means comprises a four way stretch fabric.

4. The cover of claim 3, the combination further comprising:

projecting heel covering means, integral to said stretch cover means, for covering said projecting heel;

shoe toe covering means, integral to said stretch cover means, for covering said shoe toe area; and pad means for providing a front sole attached to said stretch cover means where said stretch cover means covers said shoe front sole.

5. A method for covering a woman's shoe of a type having a projecting heel, a shoe front sole, and an upper defining a foot opening and including a shoe toe area, a shoe upper heel area, and a shoe upper instep area, the method comprising the steps of:

providing a stretch cover means for covering a surface of a woman's shoe having a D shaped opening in said stretch cover means for receiving said shoe into said stretch cover means;

providing an elastic strip having a length, first end on said elastic strip and a second end on an end of said elastic strip opposite to said first end of said elastic strip and not joined to said first end, attached along said length to a curved portion of said D shaped opening in said stretch cover means, and attached at said first end of said elastic strip to a first end of said straight side of said D shaped opening in said stretch cover means, and attached at said second end of said elastic strip to a second end of said straight side of said D shaped opening in said stretch cover means;

providing an overlap means, integral to said stretch cover means and forming a straight side of said D shaped opening in said stretch cover means, for stretching said stretch cover means across said foot opening in said shoe;

inserting a shoe into said D shaped opening in said stretch cover means and stretching said overlap means across said foot opening in said shoe from said shoe toe area to over said shoe upper instep area;

pressing a foot on top of said overlap means;

stretching said overlap means inside said shoe toe area with said foot and stretching said stretch cover means over said shoe toe area;

inserting said foot into said foot opening of said shoe; and inserting said elastic strip inside said foot opening to retain said stretch cover means on said shoe upper heel area.

* * * * *